US011768050B2

(12) United States Patent
Lewin

(10) Patent No.: US 11,768,050 B2
(45) Date of Patent: Sep. 26, 2023

(54) MUZZLE BRAKE

(71) Applicant: BAE SYSTEMS plc, London (GB)

(72) Inventor: Richard Peter Lewin, Barrow-in-Furness (GB)

(73) Assignee: BAE SYSTEMS PLC, London (GB)

( * ) Notice: Subject to any disclaimer, the term of this patent is extended or adjusted under 35 U.S.C. 154(b) by 78 days.

(21) Appl. No.: 17/904,523

(22) PCT Filed: Feb. 8, 2021

(86) PCT No.: PCT/GB2021/050272
§ 371 (c)(1),
(2) Date: Aug. 18, 2022

(87) PCT Pub. No.: WO2021/165642
PCT Pub. Date: Aug. 26, 2021

(65) Prior Publication Data

US 2023/0084391 A1 Mar. 16, 2023

(30) Foreign Application Priority Data

Feb. 20, 2020 (EP) ..... 20275046
Feb. 20, 2020 (GB) ..... 2002337

(51) Int. Cl.
*F41A 21/36* (2006.01)

(52) U.S. Cl.
CPC ..... *F41A 21/36* (2013.01)

(58) Field of Classification Search
CPC ..... F41A 21/32; F41A 21/325; F41A 21/34; F41A 21/36; F41A 21/38; F41A 21/40; F41A 21/42
USPC ..... 89/14.3
See application file for complete search history.

(56) References Cited

U.S. PATENT DOCUMENTS 6,216,578 B1* 4/2001 Ledys et al. ..... F41A 21/36 89/14.3
6,578,462 B1* 6/2003 Franchino et al. ..... F41A 21/36 89/14.3

(Continued)

FOREIGN PATENT DOCUMENTS

RU 186256 U1 1/2019
WO 2021165642 A1 8/2021

OTHER PUBLICATIONS

Extended European Search Report for EP Application No. 20275046.9, dated Aug. 4, 2020. 8 pages.

(Continued)

*Primary Examiner* — Samir Abdosh
(74) *Attorney, Agent, or Firm* — Finch & Maloney PLLC

(57) ABSTRACT

A muzzle brake (20) for a gun tube (12) defining a bore (40) centred on a longitudinal axis (32). The muzzle brake (20) comprises a top plate (24) and a bottom plate (26). A first wall section (100), a second wall section (200) and a third wall section (300) extend from the top plate (24) to the bottom plate (26).The second wall section (200) extends from the first wall section (100) to a first baffle (220). The third wall section (300) extends from the second wall section (200) to a second baffle (320). The second wall section (200), top plate (24) and bottom plate (26) converge towards the longitudinal axis (32) and the first baffle (220), such that the second wall section (200), top plate (24), bottom plate (26) and first baffle (220) define a first compression cone (224). The third wall section (300), top plate (24) and bottom plate (26) converge towards the longitudinal axis (32) and the second baffle (320) such that the third wall section (300), top plate (24), bottom plate (26) and second baffle (320) defines a second compression cone (324).

14 Claims, 7 Drawing Sheets

(56) References Cited

U.S. PATENT DOCUMENTS

| | | | | |
|---|---|---|---|---|
| 7,530,299 | B1* | 5/2009 | Poff | F41A 21/36 42/1.06 |
| 9,310,152 | B1* | 4/2016 | Poling | F41A 21/36 |
| 10,612,878 | B1* | 4/2020 | Salvador | F41A 21/325 |
| 2013/0233162 | A1* | 9/2013 | Schneider | F41A 21/36 89/14.3 |
| 2020/0224989 | A1* | 7/2020 | Bundy et al. | F41A 21/325 |
| 2021/0389075 | A1* | 12/2021 | Bray | F41A 21/36 |
| 2022/0034620 | A1* | 2/2022 | Parker | F41A 21/34 |
| 2022/0042759 | A1* | 2/2022 | Holly et al. | F41C 9/08 |
| 2022/0325972 | A1* | 10/2022 | Lovas | F41A 21/325 |

OTHER PUBLICATIONS

GB Search Report under Section 17(5) for GB Application No. 2002337.0, dated Jul. 22, 2020. 3 pages.

International Preliminary Report on Patentability for PCT Application Number: PCT/GB2021/050272. Mail date Sep. 1, 2022. 8 Pages.

International Search Report and Written Opinion for PCT/GB2021/050272, mailed: Apr. 29, 2021. 12 pages.

* cited by examiner

MUZZLE BRAKE

The present disclosure relates to a muzzle brake for a gun tube.

BACKGROUND

Muzzle brakes are used to reduce recoil energy of cannon systems, for example artillery and large calibre tubed guns. An example of a muzzle brake is shown in US7530299B1 (Charles Poff). Muzzle brakes are configured to divert a portion of the gas venting from the barrel after a projectile has exited to reduce the recoil force on the barrel, and hence reduce stress on a support structure to which the barrel is attached. The mechanism for all current muzzle brakes is that, by diverting the gas, the gas's forward momentum is reduced and the barrel's rearward momentum is reduced by a corresponding amount. Therefore the greater the volume of gas and the greater the angle of diversion, the greater the recoil efficiency of the muzzle brake.

"Recoil efficiency" defines how much energy the muzzle brake removes from the recoiling mass of the gun. For example, in a system with 100% efficiency, a gun barrel would be stopped from recoiling without the need for a buffer/recoil system to slow it down, and a 50% efficient muzzle brake will remove 50% of the kinetic energy of the recoiling barrel.

The downside of the conventional approach is that the more gas is diverted the greater the power of a blast overpressure which reaches the crew (shown to the left in FIG. 1). The blast overpressure is a single pressure wave driven by the gas expanding from the barrel and can be responsible for hearing damage and other injurious effects on the gun crew.

Hence a muzzle brake which reduces blast over pressure whilst having the same, or better, recoil efficiency, is highly desirable.

SUMMARY

According to the present disclosure there is provided a muzzle brake and an assembly comprising the muzzle brake as set forth in the appended claims. Other features of the invention will be apparent from the dependent claims, and the description which follows.

Accordingly there may be provided a muzzle brake (20) for a gun tube (12). The muzzle brake (20) may comprise a body (22) having a top plate (24) and a bottom plate (26), which extend from an inlet end (28) having an inlet aperture (29) to an outlet end (30) having an outlet aperture (31). The muzzle brake (20) may also comprise a support hub (27) defining an inlet end (23) and an outlet end (34), wherein the hub outlet end (34) extends to/from the body inlet end (28). The body (22) and support hub (27) may define a longitudinal bore (40) which extends through the body (22) and the support hub (27) between the support hub inlet end (23) and the body outlet end (30), the bore (40) being centred on a longitudinal axis (32). The body may further comprise a first wall section (100), a second wall section (200) and a third wall section (300) which extend from the top plate (24) to the bottom plate (26). The first wall section (100) defines the body inlet aperture (29). The second wall section (200) extends from the first wall section (100) along the longitudinal axis (32) and extends to a first baffle (220) which defines a bore aperture (222). A first chamber (210) is defined between the body inlet aperture (29) and the bore aperture (222). The third wall section (300) extends from the second wall section (200) along the longitudinal axis (32) and extends to a second baffle (320) which defines the body outlet aperture (31). A second chamber (310) is defined between the first baffle (220) and the body outlet aperture (31). The first wall section (100), top plate (24) and bottom plate (26) may diverge away from the longitudinal axis (32) in the section of the first chamber (210) which extends from the hub outlet (34). The second wall section (200), top plate (24) and bottom plate (26) may converge towards the longitudinal axis (32) and the first baffle (220), such that the second wall section (200), top plate (24), bottom plate (26) and first baffle (220) define a first compression cone (224). The third wall section (300), top plate (24) and bottom plate (26) may converge towards the longitudinal axis (32) and the second baffle (320) such that the third wall section (300), top plate (24), bottom plate (26) and second baffle (320) defines a second compression cone (324).

In the regions where the first wall section (100), top plate (24) and bottom plate (26) diverge away from the longitudinal axis (32), they may comprise a convex section. In the regions where the second wall section (200), top plate (24) and bottom plate (26) converge towards the longitudinal axis (32), they may comprise a concave section (230). In the regions where the third wall section (300), top plate (24) and bottom plate (26) converge towards the longitudinal axis (32), they may comprise a concave section (330).

Each of the first baffle (220) and second baffle (320) may comprise a frustoconical section (240; 340) angled to the longitudinal axis (32) which extends from the respective concave section (230; 330), and a convex section (242; 342) which curves away from the longitudinal axis (32) and defines an edge (244; 344) of the respective baffle aperture (222; 31).

The body (22) defines a pair of outlet ports (250; 350) for each of the first chamber (210) and second chamber (310), each pair of outlet ports (250; 350) facing each other on opposite sides of the longitudinal axis (32); each of the pair of outlet ports (250; 350) having a divergent outlet nozzle (252; 352) defining their periphery.

The divergent outlet nozzle (252) of the pair of first outlet ports (250) may extend a maximum distance from the longitudinal axis (32) of at least 110% but no more than 150% the maximum distance which the divergent outlet nozzle (352) of the pair of second outlet ports (350) extends from the longitudinal axis (32).

The flow area of each of the first outlet ports (250) may be about 30% larger than the flow area of each of the second outlet ports (350).

A region of the second wall section (200) may extend part of the way from the first baffle (220) to the body inlet aperture (29) to form a first chamber ridge (202), wherein the inner surface (204) of the second wall section (200) defines a surface of the first compression cone (224), and an outer surface (206) of the second wall section (200) may extend in a direction away from the longitudinal axis (32) to define part of the first port divergent outlet nozzle (252).

A region of the third wall section (300) may extend part of the way from the second baffle (320) to the first baffle (220) to form a second chamber ridge (302), wherein the inner surface (304) of the third wall section (300) may define a surface of the second compression cone (324), and an outer surface (306) of the third wall section (300) extends in a direction away from the longitudinal axis (32) to define part of the second port divergent exit nozzle (352).

Each of the first port divergent outlet nozzles (252) may comprise a channel (254) which extends from the inner surface (204) of the second wall section (200), through the outer surface (206) of the second wall section (200) and to an edge (208) of the first port divergent outlet nozzle (252). Each of the second port divergent outlet nozzles (352) may comprise a channel (354) which extends from the inner surface (304) of the third wall section (300), through the outer surface (306) of the third wall section (300) and to an edge (308) of the second port divergent outlet nozzle (352). The channel (254, 354) of each nozzle may be provided halfway between the top plate (24) and the bottom plate (26).

The combined flow area of the first chamber ports (250) may be at least four times the flow area of the bore (40); and the combined flow area of the second chamber ports (350) may be at least twice the flow area of the bore (40).

A region of the second wall section (200) may extend part of the way from the first baffle (220) to the second baffle (320) to form a first protrusion (260) that extends part of the way into the second chamber (310), the first protrusion (260) defining a first flow guide (262) with an inner cylindrical surface (264) centred on the longitudinal axis (32).

The body outlet aperture (31) may be defined by a region of the third wall section (300) which extends away from the second baffle (320) to form a second protrusion (360), the second protrusion (360) defining a second flow guide (362) with an inner cylindrical surface (364) centred on the longitudinal axis (32).

The first and second protrusions (260; 360) may vary in length around their diameter, having a short length in sections which are in line with the direction between the top plate (24) and bottom plate (26), and their greatest length in sections which are in line with the direction between their respective ports (250; 350).

At its longest, the first protrusion (260) may extend a distance from the first baffle (220) equal to at least 30% of the diameter D of the bore (40) of the support hub (27), and may extend at least 50%, but at most 100%, around the bore aperture (222). At its longest, the second protrusion (360) may extend a distance from the second baffle (320) of at least 10% of the diameter D of the bore (40) of the support hub (27), and may extend at least 50%, but at most 100%, around the body outlet aperture 222.

There may also be provided an assembly comprising the muzzle brake (20) of the present disclosure and a gun tube 12, wherein the first compression cone 224 has an inlet area of at least 200% the cross-sectional area of the gun tube 12, but no more than 350% the cross-sectional area of the gun tube 12. The first compression cone 224 may have an outlet area of at least 105% the cross-sectional area of the gun tube 12, but no more than 150% the cross-sectional area of the gun tube 12. The second compression cone 324 may have an inlet area of at least 200% the cross-sectional area of the gun tube 12, but no more than 320% the cross-sectional area of the gun tube 12. The second compression cone 324 may have an outlet area of at least 105% the cross-sectional area of the gun tube 12, but no more than 140% the cross-sectional area of the gun tube 12.

Hence there may be provided a muzzle brake configuration which achieves a low blast overpressure at crew positions by venting more gas forwards towards the exit from the muzzle, while also reducing recoil forces.

BRIEF DESCRIPTION OF THE DRAWINGS

Examples of the present disclosure will now be described with reference to the accompanying drawings, in which.

DETAILED DESCRIPTION

Figure 1:
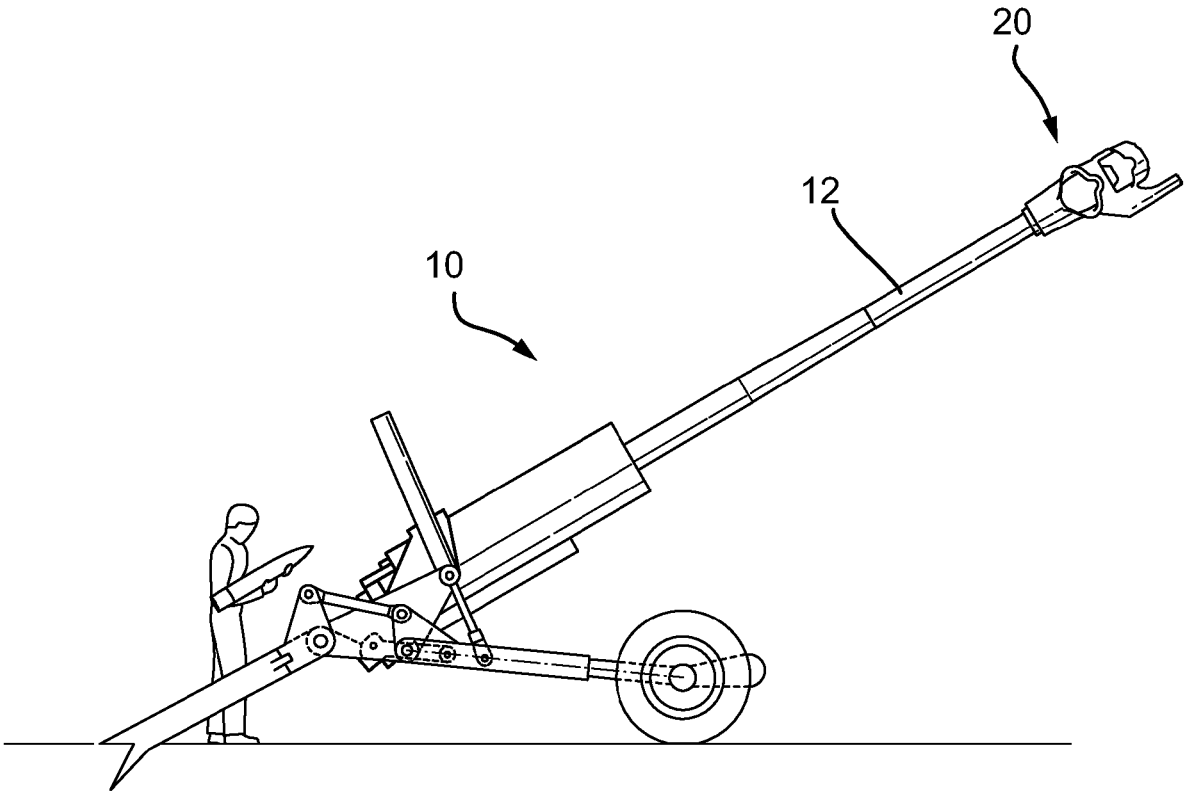
FIG. 1 shows an assembly of a gun tube and muzzle brake of the present disclosure.

By way of non limiting example, FIG. 1 shows an example of a weapon 10 to which a muzzle brake 20 of the present disclosure may be applied. The muzzle brake 20 is provided at the exit from a gun tube (i.e. a barrel) 12, as is well known and understood in the art, and also illustrated in FIG. 4. That is to say, the muzzle brake 20 is configured for use on a gun tube 12 (i.e. a barrel).

Figure 2:
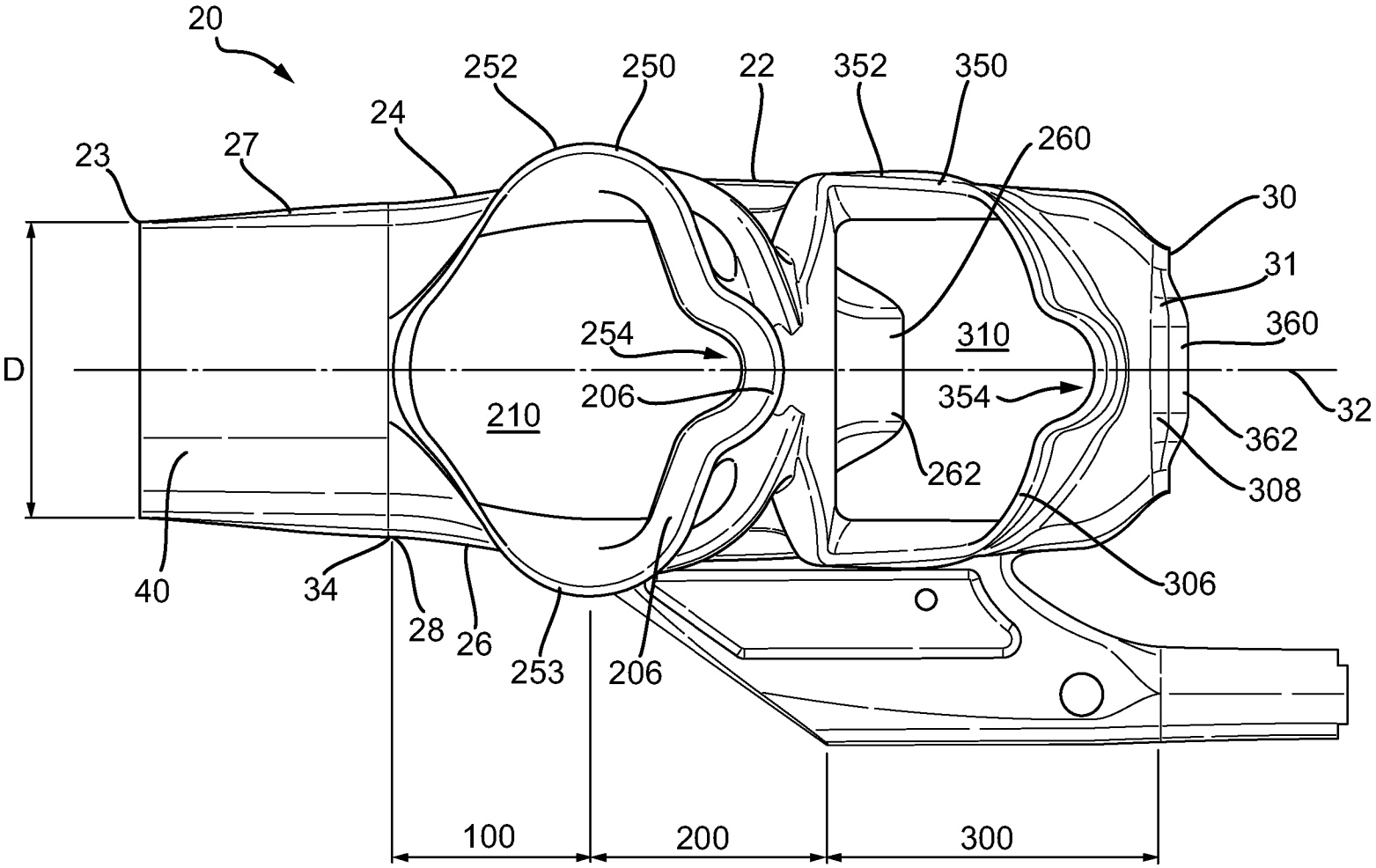
FIG. 2 shows a side view of the muzzle brake of the present disclosure.
Figure 3:
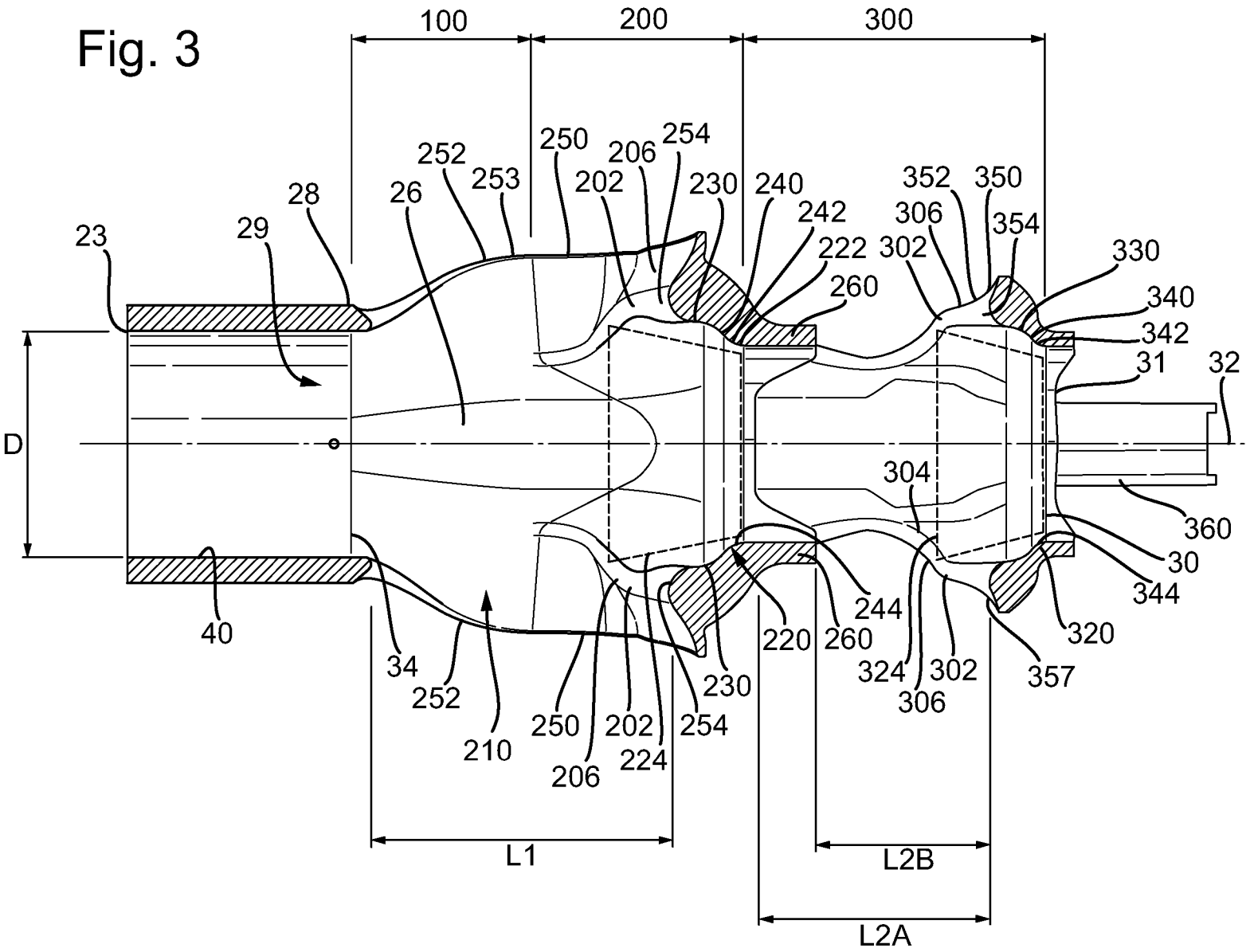
FIG. 3 shows a top view of the muzzle brake sectioned through a horizontal central plane.
Figure 4:
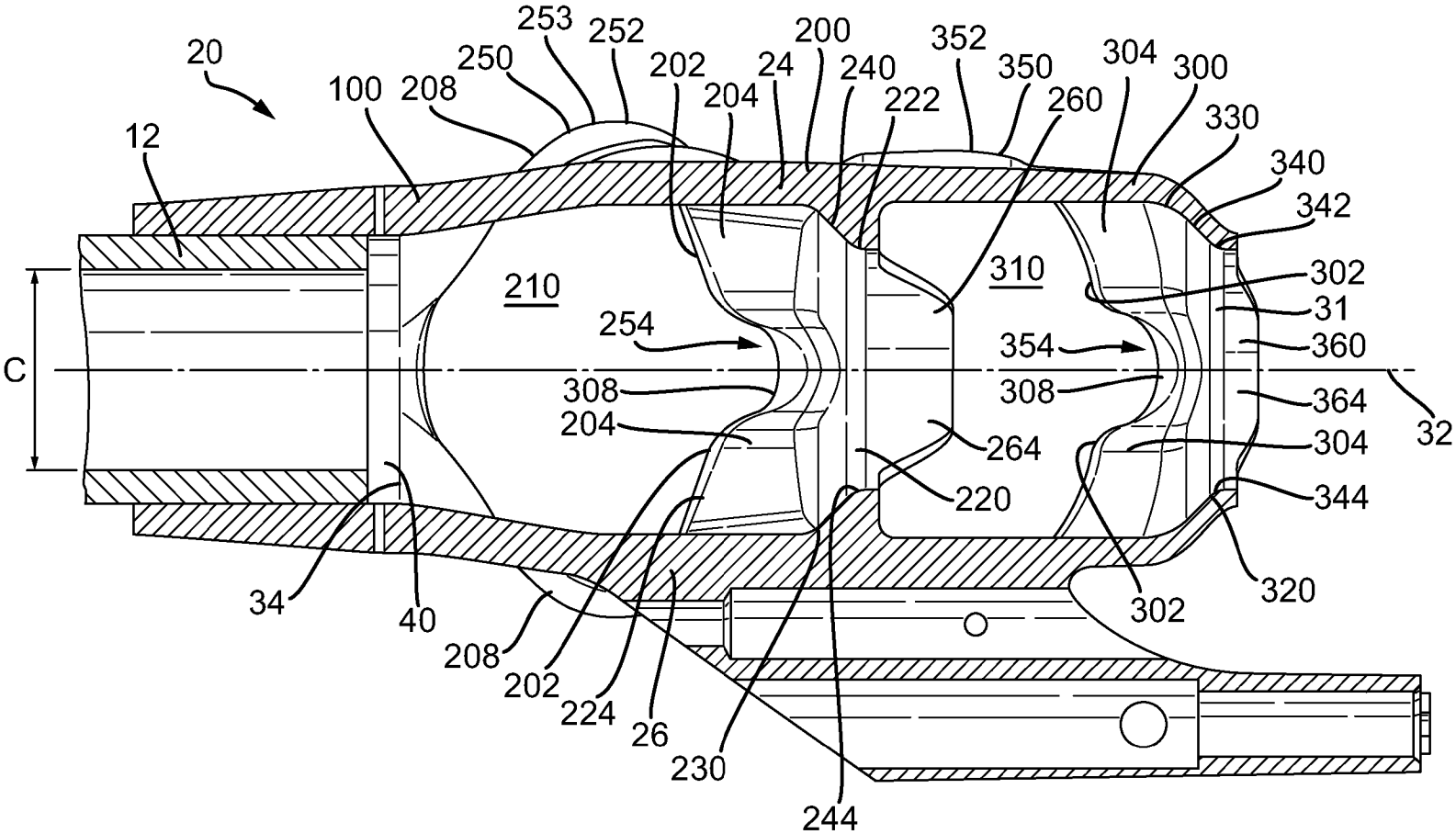
FIG. 4 shows a side view of the muzzle brake sectioned through a vertical central symmetry plane, assembled with a gun tube.
Figure 5:
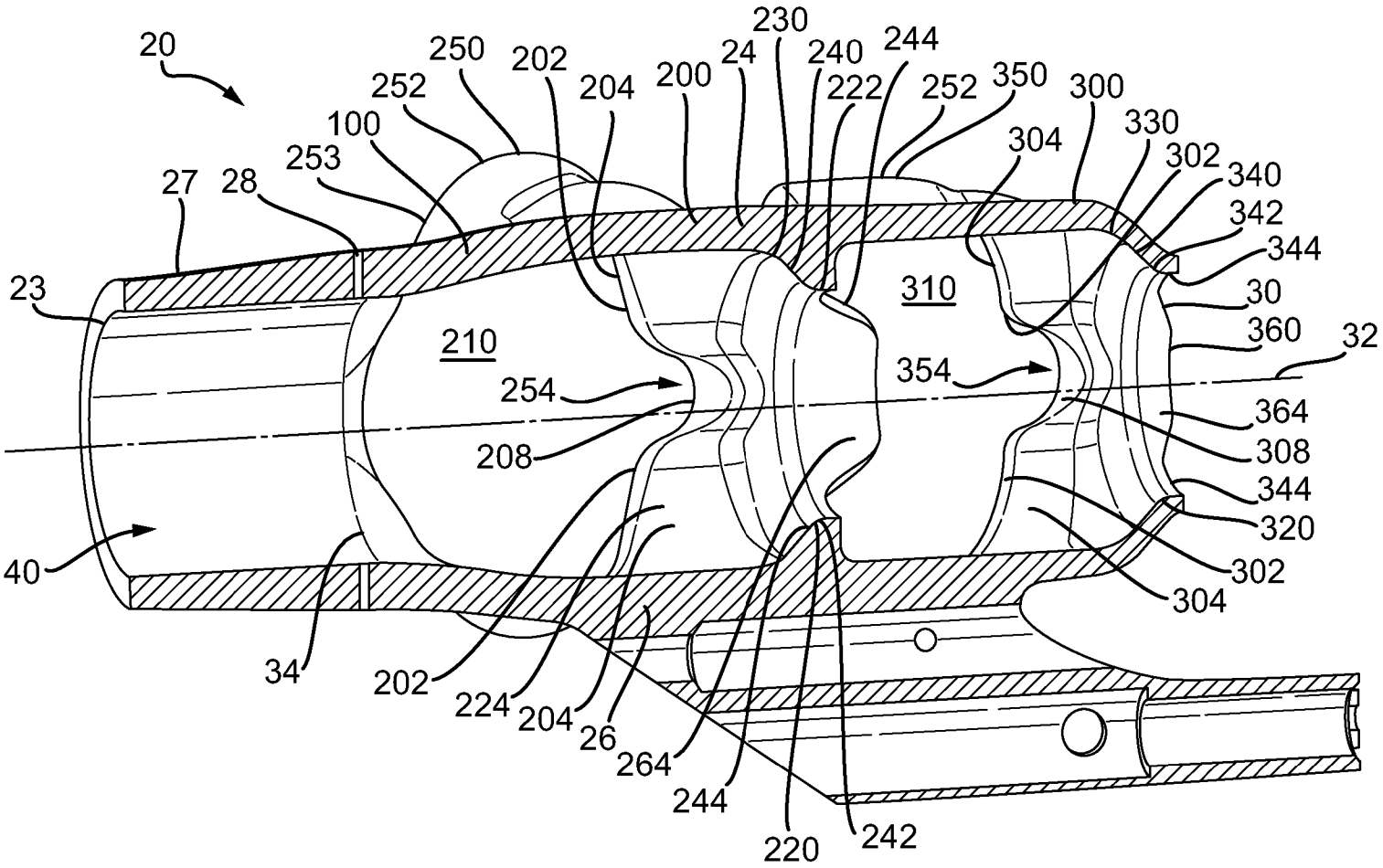
FIG. 5 shows an isometric view of the muzzle brake sectioned through the vertical central symmetry plane.
Figure 6:
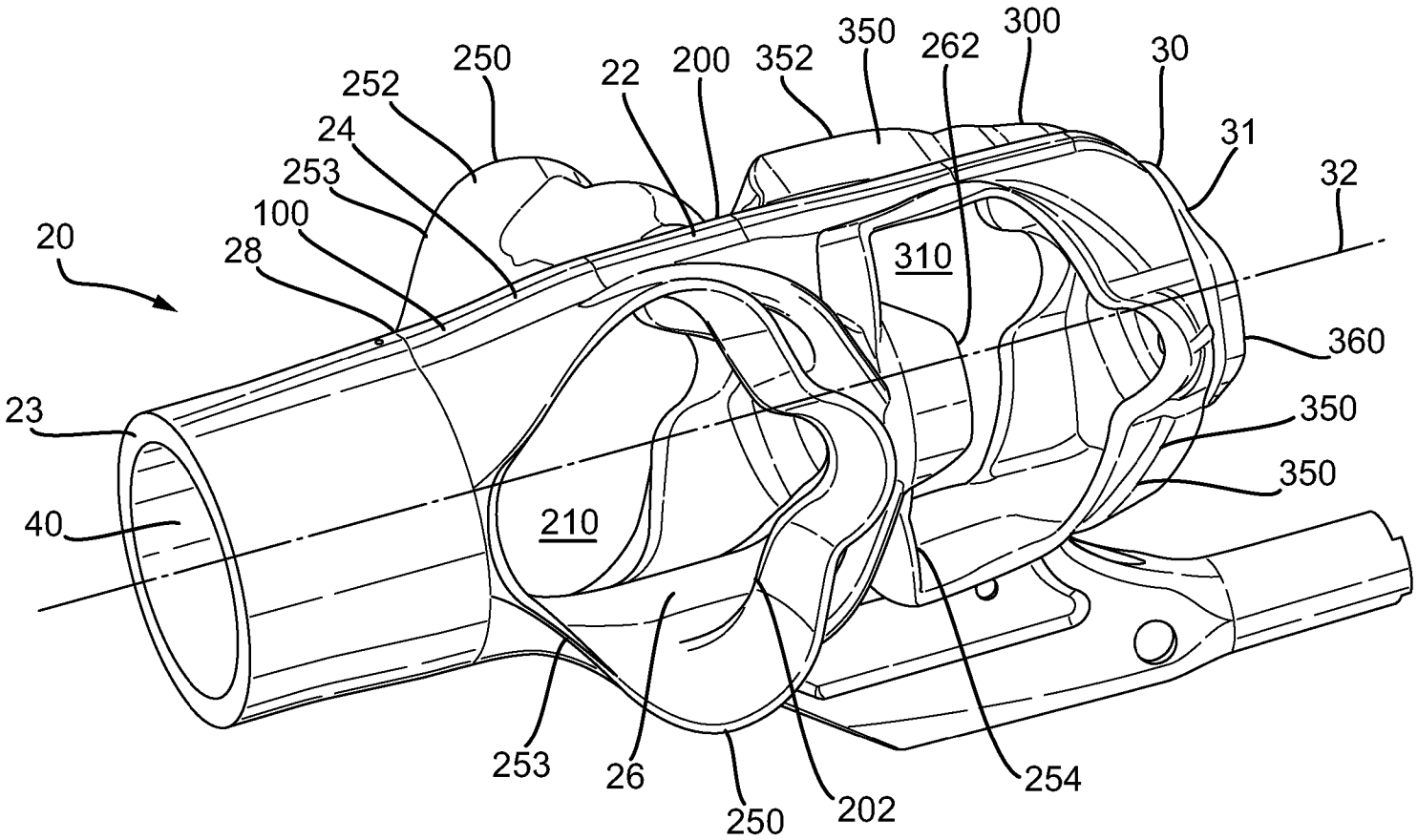
FIG. 6 shows a first isometric view of the muzzle brake.
Figure 7:
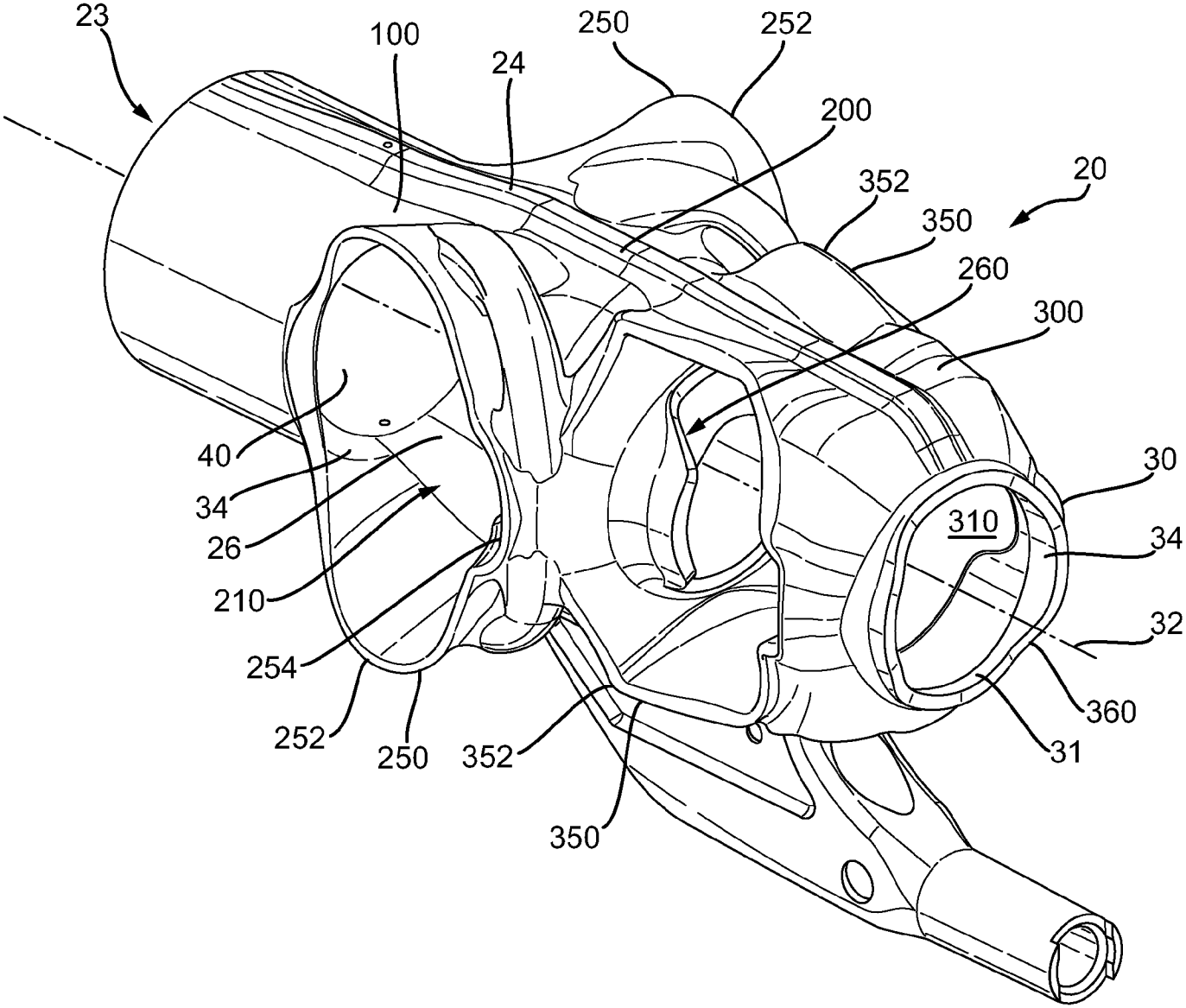
FIG. 7 shows a second isometric view of the muzzle brake.

FIGS. 2 to 6 show different views and features of the muzzle brake 20, a longitudinal bore 40 of which is centred on a longitudinal axis 32 of the muzzle brake 20. Put another way, the longitudinal bore 40 extends through the muzzle brake 20 and is centred on the longitudinal axis 32. FIG. 2 shows a side view, FIG. 3 shows a top view section through a horizontal central plane through the longitudinal axis 32 and FIG. 4 shows a side view section through a vertical central symmetry plane which extends through the longitudinal axis 32. FIG. 5 shows an isometric sectional view through a vertical central symmetry plane which extends through the longitudinal axis 32. FIG. 6 shows an isometric view of the muzzle brake 20 viewed from an inlet end 23 and FIG. 7 shows an isometric view of the muzzle brake viewed from the outlet end 30.

The muzzle brake 20 comprises a body 22 having a top plate 24 and a bottom plate 26. The top plate 24 and a bottom plate 26 face each other on opposite sides of the longitudinal axis 32. A support hub 27 defines the inlet end 23 and a support hub outlet end 34. The top plate 24 and bottom plate 26 extend from an inlet end 28 of the body 22, of which the inlet end 28 defines an inlet aperture 29, to an outlet end 30 of the body 22, which defines an outlet aperture 31. The body 22 further comprises a first wall section 100, a second wall section 200 and a third wall section 300 which extend from the top plate 24 to the bottom plate 26. As best shown in FIGS. 2, 3, at least the first wall section 100 defines the body inlet aperture 29 (i.e. the inlet end 28). The body inlet aperture 29 (i.e. the inlet end 28) may be defined by the first wall section 100, top plate 24 and bottom plate 26.

The muzzle brake 20 may be integrally formed (i.e. provided as a mono structure), and it will be appreciated that the terms top plate 24, bottom plate 26, first wall section 100, second wall section 200 and third wall section 300 referto different sections of this integrally formed structure. FIGS. 2, 3 illustrate the different sections of the structure of the muzzle brake 20 to which these terms refer.

The hub outlet end 34 extends from the body inlet end 28 of the support hub 27. The body 22 and support hub 27 define the longitudinal bore 40 which extends through the body 20 and the support hub 27 between the support hub inlet end 23 and the body outlet end 30. The section of the bore 40 defined by the support hub 27 may have a constant diameter along the length of the support hub 27. However, the section of the bore 40 defined by the body 22 may vary in width and cross-sectional shape and area along its length, as will be described below, and as is evident from the figures.

The bore 40 of the support hub 27 may be substantially equal to the external diameter of the gun tube 12, for example so the gun tube 12 can fit into the support hub 27 as shown, by way of non limiting example, in FIG. 4. Hence the calibre "C" (i.e. internal diameter) of the bore of the gun tube 12 may be less than the diameter D of the bore 40 of the support hub 27.

In alternative examples, the diameter D of the bore 40 of the support hub 27 may be substantially equal to the calibre C (i.e. internal diameter) of the gun tube 12, with the bore of the gun tube 12 being aligned with the bore 40 of the support hub 27.

The first wall section 100 defines the body inlet aperture 29.

The second wall section 200 extends from the first wall section 100 along the longitudinal axis 32, away from the support hub 27, and extends to a first baffle 220 which defines a bore aperture 222. A first chamber 210 is defined between the body inlet aperture 29 and the bore aperture 222.

The third wall section extends from the second wall section 200 in the direction of the longitudinal axis 32 and extends to a second baffle 320 which defines the body outlet aperture 31. A second chamber 310 is defined between the first baffle 220 and the body outlet aperture 31. That is to say, the second chamber 310 is defined between the first baffle 220 and the second baffle 320. Hence the bore 40 in the body 22 is defined, in series, by the body inlet aperture 29, the first chamber 210, the bore aperture 222, the second chamber 310 and the body outlet aperture 31.

It will be appreciated that the baffles 220, 320 may be integrally formed with the body 22 and hence the wall sections from which they extend. However they are described as separate features, even though they may be part of the same component, in order to distinguish the features of the geometry of the body 22.

The first wall section 100, top plate 24 and bottom plate 26 may diverge away from the longitudinal axis 32 in the section of the first chamber 210 which extends from the hub outlet 34 and body inlet 28. Conversely the second wall section 200, top plate 24 and bottom plate 26 may converge towards the longitudinal axis 32 and the first baffle 220, such that the second wall section 200, top plate 24, bottom plate 26 and first baffle 220 define a first compression cone 224. The region corresponding to the first compression cone 224 is indicated with a dotted trapezium in FIG. 3, and features of the compression cone 224 will be described in more detail below. The third wall section 300, top plate 24 and bottom plate 26 converge towards the longitudinal axis 32 and the second baffle 320 to define a second compression cone 324, the location of which is indicated with a dotted trapezium in FIG. 3.

In the regions where the first wall section 100, top plate 24 and bottom plate 26 diverge away from the longitudinal axis 32, they may comprise (i.e. may be defined by) a convex section (i.e. surface) which curves away from the longitudinal axis 32.

In the regions where the second wall section 200, top plate 24 and bottom plate 26 converge towards the longitudinal axis 32, they may comprise (i.e. may be defined by) a concave section (i.e. profile) 230 which curves towards the longitudinal axis 32 and extends to the first baffle 220. Likewise in the regions where the third wall section 300, top plate 24 and bottom plate 26 converge towards the longitudinal axis 32, they comprise (i.e. may be defined by) a concave section (i.e. profile) 330 which curves towards the longitudinal axis 32 and extends to the second baffle 320.

That is to say, the wall sections 200, 300 and top plate 24 and bottom plate 26 may comprise a curved region and/or profile in sections where their surfaces turn and extend towards the baffle plates 220, 320.

Thus the geometry of the wall sections 100, 200, 300, top plate 24 and bottom plate 26 may comprise (i.e. may be defined by) curved profiles configured to reflect shockwaves to varying degrees along their surface length in the direction of the longitudinal axis 32. The geometry of the wall sections 100, 200, 300, top plate 24 and bottom plate 26 may comprise only, or predominantly, curved surfaces (i.e. having no flat/straight regions).

Each of the first baffle 220 and second baffle 320 may comprise a frustoconical section 240, 340 angled to the longitudinal axis 32 which extends from the respective concave section 230, 330, and a convex section 242, 342 which curves away from the longitudinal axis and defines an edge 244, 344 of the respective baffle aperture 222, 31. Put another way, the first baffle 220 and second baffle 320 may each comprise a frustoconical section 240, 340 which may be angled to the longitudinal axis 32 and comprise a zero curvature region and/or a curved surface region, which extends to a convex surface 242, 342 which provides a transition to a section parallel to the longitudinal axis 32 in their respective apertures 222, 31.

The body 22 defines a pair of outlet ports 250, 350 for each of the first chamber 210 and second chamber 310, each pair of outlet ports 250, 350 facing each other on opposite sides of the longitudinal axis 32. Each of the pair of ports 250, 350 have the same effective flow area. That is to say each of the pair of first chamber 210 outlet ports 250 have the same effective flow area as each other, and each of the pair of second chamber 310 outlet ports 350 have the same effective flow area as one another. However, the effective flow area of the first chamber 210 outlet ports 250 may be substantially larger than the effective flow area of the outlet ports 350 of the second chamber 310.

The first ports 250 are larger (i.e. have a larger effective flow area) than the second ports 350 as, in operation, there is a greater mass flow of gas which passes into the first chamber 210 compared to the second chamber 310, as in operation some of the flow of gas will escape through the first ports 250 before passing into the second chamber 310.

The effective flow area of each of the first chamber outlet ports 250 may be at least 20% larger than the effective flow area of the second chamber outlet ports 350, but no more than about 60% larger than the flow area of the second chamber outlet ports 350. The effective flow area of each of the first chamber outlet ports 250 may be about 30% larger than the flow area of each of the second chamber outlet ports 350.

The combined flow area of the first chamber outlet ports 250 may be at least four times greater than the flow area of the section of the bore 40 defined by the support hub 27. Alternatively the combined flow area of the first chamber outlet ports 250 may be at least five times greater than the flow area of the section of the bore 40 defined by the support hub 27. The combined flow area of the second chamber outlet ports 350 may be at least twice the flow area of the section of the bore 40 defined by the support hub 27. Alternatively the combined flow area of the second chamber outlet ports 350 may be at least three, but no more than 3.5, times greater than the flow area of the section of the bore 40 defined by the support hub 27.

Each of the pair of outlet ports 250, 350 may have a divergent outlet nozzle 252, 352 defining their periphery. The divergent outlet nozzles 252, 352 are symmetrical about a centre line which is parallel to the longitudinal axis 32. Each of the divergent outlet nozzles 252 of the first chamber 210 may comprise a flared skirt 253 which define their periphery.

The divergent outlet nozzles 252, 352 are shaped to direct flow to the side and forwards (i.e. in a direction of travel of a projectile through the gun tube 12, towards the exit end of the muzzle brake 20).

The divergent outlet nozzle 252 of each of the pair of first outlet ports 250 may extend a maximum distance from the longitudinal axis 32 of at least 110% but no more than 150% the maximum distance which the divergent outlet nozzle 352 of each of the pair of second outlet ports 350 extends from the longitudinal axis 32. The divergent outlet nozzle 252 of each of the pair of first outlet ports 250 may extend about 125% of the distance from the longitudinal axis 32 more than the divergent outlet nozzle 352 of each of the pair of second outlet ports 350 extends from the longitudinal axis 32.

Corresponding to each of the first port divergent outlet nozzles 252, a region of the second wall section 200 extends part of the way from the first baffle 220 towards the body inlet aperture 29 to form a first chamber ridge (i.e. fin) 202. Each of the first chamber ridges 202 extend between the top plate 24 and bottom plate 26. The inner surface 204 of the second wall section 200 defines a surface of the first compression cone 224, and an outer surface 206 of the second wall section 200 extends in a direction away from the longitudinal axis 32 to define part of one of the first port divergent outlet nozzles 252. Hence, for each first port divergent outlet nozzle 252, there is a ridge/fin 202 and corresponding surfaces 204, 206 which are a mirror image of the ridge/fin 202 and corresponding surfaces 204, 206 on the opposite side of the longitudinal axis 32.

Each outer surface 206 extends from the edge of the first port outlet nozzle 252. Each outer surface 206 defines a concave curve such that the surface extends from the edge of its respective first port nozzle 252 towards the body inlet aperture 29. Each outer surface 206 transitions into its respective first chamber ridge 202, which defines a convex curve and transitions into its respective inner surface 204. Each inner surface 204 defines a concave curve which extends towards the first baffle 220.

Hence the surface of the body 22 between the edges of the first port outlet nozzle 252 on either side of the longitudinal axis 32, may comprise only curved regions (i.e. no flat surfaces). The regions may transition from one to the other between the edge of each first port outlet nozzle 252 to the first baffle 220 to define, in series, a concave outer surface 206, a convex ridge 202 and a concave inner surface 204, each of which may have a change in rate of change of curvature along their length.

Likewise, corresponding to each of the second port divergent outlet nozzles 352 a region of the third wall section 300 extends part of the way from the second baffle 320 towards the first baffle 220 to form a second chamber ridge (i.e. fin) 302. Each of the second chamber ridges 302 extend between the top plate 24 and bottom plate 26. The inner surface 304 of the third wall section 300 defines a surface of the second compression cone 324, and an outer surface 306 of the third wall section 300 extends in a direction away from the longitudinal axis 32 to define part of one of the second port divergent exit nozzle 352.

Each outer surface 306 extends from the edge of the second port outlet nozzle 352. Each outer surface 306 defines a concave curve such that the surface extends from the edge of its respective the second port outlet nozzle 352 towards the bore aperture 222. Each outer surface 306 transitions into its respective second chamber ridge 302, which defines a convex curve and transitions into its respective inner surface 304. Each inner surface 304 defines a concave curve which extends towards the second baffle 320.

Hence the surface of the body 22 between the edges of the second port outlet nozzle 352 on either side of the longitudinal axis 32 may comprise only curved regions (i.e. no flat surfaces). The regions transition from one to the other between the edge of each second port outlet nozzle 352 to the second baffle 320 to define, in series, a concave outer surface 306, a convex ridge 302 and a concave inner surface 304, each of which may have a change in rate of change of curvature along their length.

The first compression cone 224 has an inlet area defined by the ridges 202, the top plate 24 and bottom plate 26. The second compression cone 324 has an inlet area defined by the ridges 302, the top plate 24 and bottom plate 26.

The first compression cone 224 has an outlet area defined by the first baffle plate 220 aperture 222. The second compression cone 324 has an outlet area defined by the second baffle plate 320 aperture 31.

In an assembly comprising the muzzle brake 20 and a gun tube 12, the first compression cone 224 may have an inlet area of at least twice the cross-sectional area of the bore of the gun tube 12, but no more than 3.5 times the cross-sectional area of the bore of the gun tube 12. The first compression cone 224 may have an inlet area of about 3.1 times the cross-sectional area of the bore of the gun tube 12.

In an assembly comprising the muzzle brake 20 and a gun tube 12, the first compression cone 224 may have an outlet area of at least 1.05 times of the cross-sectional area of the bore of the gun tube 12, but no more than 1.5 times the cross-sectional area of the bore of the gun tube 12.

The first compression cone 224 may have an outlet area of about 1.25 times the cross-sectional area of the bore of the gun tube 12.

In an assembly comprising the muzzle brake 20 and a gun tube 12, the second compression cone 324 may have an inlet area of at least twice the cross-sectional area of the bore of the gun tube 12, but no more than 3.2 times the cross-sectional area of the bore of the gun tube 12. The second compression cone 324 may have an inlet area of about 2.8 times the cross-sectional area of the bore of the gun tube 12.

In an assembly comprising the muzzle brake 20 and a gun tube 12, the second compression cone 324 may have an outlet area of at least 1.05 times the cross-sectional area of the bore of the gun tube 12, but no more than 1.4 times the cross-sectional area of the bore of the gun tube 12. The second compression cone 224 may have an outlet area of about 1.2 times the cross-sectional area of the bore of the gun tube 12.

The geometry of the surfaces of the body 22 are thus configured such that the first compression cone 224 has a greater volumetric capacity (i.e. define a greater volume) than the second compression cone 324. That is to say, the features of the second wall section 200 that extend away from the first baffle 220 to create an inlet guide surface 204 of the first compression cone 224, and the region of the third wall section 300 that extends from the second baffle 320 to form an inlet guide surface 304 of the second compression cone 324, and the top plate 24 and bottom plate 26, and baffles 220, 320 define compression cones with different volumes within the first chamber 210 and second chamber 310, and the volume of the first compression cone 224 is greater than the volume of the second compression cone 324.

The regions of the second wall section 200 and the third wall section 300 which define their respective compression cones 224, 324 are defined with a continuously curved surface. That is to say, the regions of the second wall section 200 and the third wall section 300 which define their respective compression cones 224, 324 do not have any flat/straight/non curved regions.

The first ports 250 have a length L1. As shown in FIG. 3, the length L1 is the distance measured from the inlet aperture 29 of the body 22, from which the first port 250 extends, to the opposite side of the port 250 defined by the ridge 202, the distance L1 being measured halfway between the top plate 24 and bottom plate 26, and parallel to the longitudinal axis 32.

In an assembly comprising the muzzle brake 20 and a gun tube 12 having a calibre C, the first port length L1 may be at least 100% of the calibre C of the barrel 12, but less than 225% of the calibre C of the barrel 12. The first port length L1 may be about 175% of the calibre C of the barrel 12.

The second ports 350 have a length L2A. As shown in FIG. 3, the length L2A is the distance measured from the back/exit of the first baffle 220, to the opposite side of the port 350 defined by the ridge 302, the distance L2A being measured halfway between the top plate 24 and bottom plate 26, and parallel to the longitudinal axis 32.

In an assembly comprising the muzzle brake 20 and a gun tube 12 having a calibre C, the full length 2A of the second port 350, may be at least the same length as the calibre C of the barrel 12, but less than 160% of the calibre C of the barrel 12. The full length 2A of the second port 350 may be about 135% of the calibre C of the barrel 12.

The second ports 350 may also be defined as having a length L2B. As shown in FIG. 3, the length L2B is the distance measured from the end/exit of the first protrusion 260 (flash suppressor), to the opposite side of the port 350 defined by the ridge 302, the distance L2B being measured halfway between the top plate 24 and bottom plate 26, and parallel to the longitudinal axis 32.

In an assembly comprising the muzzle brake 20 and a gun tube 12 having a calibre C, the second port 350 length L2B may be at least 75% of the calibre C of the barrel 12, but less than 150% of the calibre C of the barrel 12. The second port 350 length L2B may be about the same length as the calibre C of the barrel 12.

Each of the first port divergent outlet nozzles 252 comprises a channel 254 which extends from the inner surface 204 of the ridge 202 of the second wall section 200, through the outer surface 206 of the ridge 202 of the second wall section, and to an edge 208 of the first port divergent nozzle 252. Likewise each of the second port divergent outlet nozzles 352 comprises a channel 354 which extends from the inner surface 304 of the ridge 302 of the third wall section 300, through the outer surface 306 of the ridge 302 of the third wall section 300 and to an edge 308 of the second port divergent outlet nozzle 352. Hence the channel 254 of the first port divergent outlet nozzle 252 extends through the flared skirt region 253 of the divergent outlet nozzle 252. The channel 254, 354 of each nozzle is provided halfway between the top plate 24 and the bottom plate 26. The first chamber channel 254 is hence formed in the same wall/ridge 202 which extends towards the first baffle 220 and provides a flow route from the first compression cone 220 to the outside of the body 22. Likewise the second channel 354 of the second port divergent outlet nozzle 352 extends from the ridge/wall 302 which defines the second compression cone 324 to define a flow route from the second compression cone 324 to the outside of the body 22.

A region of the second wall section 200 may extend part of the way from the first baffle 220 to the second baffle 320 to form a first protrusion 260 that extends part of the way into the second chamber 310. The first protrusion 260 defines a first flow guide 262 with an inner cylindrical surface 264 centred on the longitudinal axis 32.

The body outlet aperture 31 may be defined by a region of the third wall section 300 which extends from the second baffle 320 to form a second protrusion 360, the second protrusion 360 defining a second flow guide 362 with an inner cylindrical surface 364 centred on the longitudinal axis 32.

The first protrusion 260 and second protrusion 360 may vary in length around their diameter. That is to say, around their respective diameters, the first protrusion 260 and the second protrusion 360 may extend by different amounts from their base. Hence in some regions the they each may be defined by a wall with a first length, and in other regions defined by a wall with a length greater than the first length. The regions in which they have a shorter length (i.e. extend a smaller distance) may be sections which are in line with the direction between the top plate 24 and bottom plate 26, and they may have the greatest length in sections which are in line with the direction between their respective ports 250, 350. That is to say, the regions having the greatest length (which extend furthest from their base) face the ports 250, 350 and the regions which extend to a lesser extent from their base may face the top plate 24 and bottom plate 26.

At its longest, the first protrusion 260 may extend a distance from the first baffle 220 equal to at least 30% of the diameter D of the bore 40 of the support hub 27, and may extend at least 50%, but at most 100%, around the bore aperture 222. At its longest, the second protrusion 360 may extend a distance from the second baffle 320 of at least 10% of the diameter D of the bore 40 of the support hub 27, and may extend at least 50%, but at most 100%, around the body outlet aperture 222.

Hence the protrusions 260, 360 may vary (i.e. change, differ) in height around their respective circumferences, having heights in two opposed regions greater than in the other two regions. That is to say the regions of greatest/lowest height are opposite one another across the longitudinal axis 32.

In an alternative example, the protrusions 260, 360 may have a constant height around their respective circumferences.

In operation, for example when a projectile is fired from the gun tube 12, the projectile will pass through and exit the muzzle brake 20. After the projectile has left the muzzle brake 20, gas will flow into the first chamber 210. A proportion of the gas will flow through the first ports 250 in a direction defined by the divergent outlet nozzle 252. The remainder of the gas is compressed as it flows into the first compression cone 224. The flow rate into the first compression cone 224 may be larger than can pass through the bore aperture 222 of the first baffle 220, and thus the flow may become choked. However, the first chamber channels 254 provide a flow route from the first compression cone 220 to the outside of the body 22 to prevent choking, or at least reduce the period during which choking occurs.

The first protrusion 260 also helps to establish flow from the first chamber 210 into the second chamber 310 during a choked condition. Further flow will exit via the second ports 350 in the second chamber 310. The remainder of the gas is compressed as it flows into the second compression cone 324. The flow rate into the second compression cone 324 may be larger than can pass through the outlet aperture 31 the second baffle 320, and thus may become choked. However, the second chamber channel 354 provides a flow route from the second compression cone 320 to the outside of the body 22 to prevent choking, or at least reduce the period during which choking occurs.

The divergent outlet nozzles 252, 325 guide air flow forwards (i.e. at an angle to the perpendicular axis 32, in a direction towards the muzzle brake outlet 31) so as to not induce a net force at an angle to the longitudinal axis 32.

Hence there is provided a two baffle muzzle brake design which is operable to produce a blast overpressure about 20% lower than examples of the related art, whilst having the same efficiency or better recoil efficiency.

The use of two baffles is beneficial in terms of noise, efficiency and weight. Using one baffle may be 25-30% less efficient than using two, whereas adding a third baffle or more adds considerable extra weight (along with length and cost/difficulty of manufacture) but only increases efficiency by a few percent.

The main efficiency is derived from the compression cones 224, 324. About 90% of the efficiency of the muzzle brake of the present disclosure is derived from recompressing the gas and ejecting it forwards rather than redirecting it sideways. This helps to achieve a lower blast overpressure at the crew positions (i.e. at the opposite end of the gun tube 12 from the muzzle exit 30) by venting more gas forwards.

The protrusions 260 on the back of the first baffle 220 reduce interference between the flow from the first ports 250 and second ports 350 reducing blast overpressure directed at the crew (i.e. towards the opposite end of the gun tube 12 from the muzzle exit 31).

The protrusions 360 on the back of the second baffle 320 stop the outlet aperture 31 from being uniform. This helps to break up the downstream flow thereby reducing the duration of the blast overpressure.

The size and shape of the ports 250, 350 of the apparatus of the present disclosure are beneficial because they minimise exhaust pressure. This reduces the blast overpressure and increases efficiency by reducing the choking effect that smaller ports can have on the flow. The choking effect reduces efficiency by creating a backpressure on the forward facing surfaces of the brake (i.e. the surfaces facing towards the body outlet end 30).

In examples in which the geometry of the internal surface of the body 22 (for example the baffles 210, 310 and the lead in to the baffles (the cones 224, 324)) comprise only, or mainly, curved surfaces which merge from one curvature to another, are also advantageous as a surface with changing curvatures reduce the size of areas which can uniformly redirect or reflect gas flows/shockwaves, thereby greatly reducing reflections back towards the crew position. They also greatly reduce shock loading of the rest of the structure (up to less than half of some examples of the related art). They also break up flow from the side ports 250, 350 helping to reduce the duration of the blast overpressure, which helps to reduce the damage caused by the blast overpressure.

The geometry (i.e. changing curved surfaces) of the baffles 210, 310 and the lead in to the baffles (the cones 224, 324) are also advantageous as they minimise erosion of the muzzle brake surface by minimising the angle at which the gas flow can strike a surface. Erosion may be caused by propellant gas driving the projectile through the gun tube 12 and/or the particulates contained in the gas.

Attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

The invention claimed is:

1. A muzzle brake for a gun tube, the muzzle brake comprising:

a body having a top plate and a bottom plate, which extend from an inlet end having an inlet aperture to an outlet end having an outlet aperture, the body further having a first wall section, a second wall section and a third wall section, which extend from the top plate to the bottom; and a support hub defining an inlet end and an outlet end, wherein the support hub outlet end extends to/from the body inlet end; and the body and support hub define a longitudinal bore which extends through the body and the support hub between the support hub inlet end and the body outlet end, the longitudinal bore being centred on a longitudinal axis;

the first wall section defines the body inlet aperture; and the second wall section extends from the first wall section along the longitudinal axis and extends to a first baffle which defines a bore aperture, a first chamber being defined between the body inlet aperture and the bore aperture; and the third wall section extends from the second wall section along the longitudinal axis and extends to a second baffle which defines the body outlet aperture, a second chamber being defined between the first baffle and the body outlet aperture; and the first wall section, top plate and bottom plate diverge away from the longitudinal axis in a section of the first chamber which extends from the hub outlet; and the second wall section, top plate and bottom plate converge towards the longitudinal axis and the first baffle, such that the second wall section, top plate, bottom plate and first baffle (220) define a first compression cone; and the third wall section, top plate and bottom plate converge towards the longitudinal axis and the second baffle such that the third wall section, top plate, bottom plate and second baffle define a second compression cone; and the body defines a first pair of outlet ports for the first chamber and a second pair of outlet ports for the second chamber, the outlet ports of the first pair facing each other on opposite sides of the longitudinal axis, and the outlet ports of the second pair facing each other on opposite sides of the longitudinal axis; and each of the outlet ports for the first and second chambers having a divergent outlet nozzle defining their periphery.

2. The muzzle brake of claim 1, wherein:

in the regions where the first wall section, top plate and bottom plate diverge away from the longitudinal axis, they comprise a convex section;

in the regions where the second wall section,top plate and bottom plate converge towards the longitudinal axis, they comprise a concave section; and in the regions where the third wall section, top plate and bottom plate converge towards the longitudinal axis, they comprise a concave section.

3. The muzzle brake of claim 2, wherein each of the first baffle and second baffle comprises a frustoconical section angled to the longitudinal axis which extends from the respective concave section, and a convex section which curves away from the longitudinal axis and defines an edge of the respective baffle aperture.

4. The muzzle brake of claim 1, wherein each of the divergent outlet nozzles of the first pair of outlet ports extends a maximum distance from the longitudinal axis of at least 110% but no more than 150% the maximum distance which each of the divergent outlet nozzles of the second pair of outlet ports extends from the longitudinal axis.

5. The muzzle brake of claim 1, wherein the flow area of each of the first pair of outlet ports is about 30% larger than the flow area of each of the second pair of outlet ports.

6. The muzzle brake of claim 1, wherein a region of the second wall section extends part of the way from the first baffle to the body inlet aperture to form a chamber ridge, wherein an inner surface of the second wall section defines a surface of the first compression cone, and an outer surface of the second wall section (200) extends in a direction away from the longitudinal axis to define part of one of the divergent outlet nozzles of the first pair of outlet ports.

7. The muzzle brake of claim 1, wherein a region of the third wall section extends part of the way from the second baffle to the first baffle to form a chamber ridge, wherein an inner surface of the third wall section defines a surface of the second compression cone, and an outer surface of the third wall section extends in a direction away from the longitudinal axis to define part of one of the divergent exit nozzles of the second pair of outlet ports.

8. The muzzle brake of claim 7, wherein:

each of the divergent outlet nozzles of the first pair of outlet ports comprises a channel which extends from an inner surface of the second wall section, through an outer surface of the second wall section and to an edge of the corresponding divergent outlet nozzle;

each of the divergent outlet nozzles of the second pair of outlet ports comprises a channel which extends from an inner surface of the third wall section, through an outer surface of the third wall section and to an edge of the corresponding divergent outlet nozzle; and the channel of each divergent outlet nozzle being provided halfway between the top plate and the bottom plate.

9. The muzzle brake of claim 1, wherein:

the combined flow area of the first pair of outlet ports for the first chamber is at least four times the flow area of the longitudinal bore; and the combined flow area of the second pair of outlet ports for the second chamber is at least twice the flow area of the longitudinal bore.

10. The muzzle brake of claim 1, wherein a region of the second wall section extends part of the way from the first baffle to the second baffle to form a protrusion that extends part of the way into the second chamber, the protrusion defining a flow guide with an inner cylindrical surface centred on the longitudinal axis.

11. The muzzle brake of claim 10, wherein the protrusion is a first protrusion and the flow guide is a first flow guide, and the body outlet aperture is defined by a region of the third wall section which extends away from the second baffle to form a second protrusion, the second protrusion defining a second flow guide with an inner cylindrical surface centred on the longitudinal axis.

12. The muzzle brake of claim 11, wherein the first and second protrusions vary in length around their diameter, having a short length in sections which are in line with the direction between the top plate and bottom plate, and their greatest length in sections which are in line with the direction between their respective outlet ports.

13. The muzzle brake of claim 11, wherein:

at its longest, the first protrusion extends a distance from the first baffle equal to at least 30% of the diameter D of the longitudinal bore of the support hub, and extends at least 50%, but at most 100%, around the bore aperture; and at its longest, the second protrusion extends a distance from the second baffle of at least 10% of the diameter D of the longitudinal bore of the support hub, and extends at least 50%, but at most 100%, around the body outlet aperture.

14. An assembly comprising the muzzle brake (20) of claim 1 and a gun tube, wherein:

the first compression cone has an inlet area of at least 200% the cross-sectional area of the gun tube, but no more than 350% the cross-sectional area of the gun tube;

the first compression cone has an outlet area of at least 105% the cross-sectional area of the gun tube, but no more than 150% the cross-sectional area of the gun tube;

the second compression cone has an inlet area of at least 200% the cross-sectional area of the gun tube, but no more than 320% the cross-sectional area of the gun tube; and the second compression cone has an outlet area of at least 105% the cross-sectional area of the gun tube, but no more than 140% the cross-sectional area of the gun tube.

* * * * *